US005100359A

United States Patent [19]

Gorio

[11] Patent Number: 5,100,359

[45] Date of Patent: Mar. 31, 1992

[54] TOY MADE OF SEVERAL INTERCONNECTABLE AND ADAPTABLE UNITS

[76] Inventor: Francesco M. Gorio, Via Asti, 6, 25100 Brescia, Italy

[21] Appl. No.: 546,444

[22] Filed: Jul. 3, 1990

[30] Foreign Application Priority Data

Jul. 7, 1989 [IT] Italy ..... 21131 A/89

[51] Int. Cl.[5] ..... A63H 33/08

[52] U.S. Cl. ..... 446/124; 446/85; 273/157 R; 434/211

[58] Field of Search ..... 446/125, 124, 85; 273/157 R, 157 A; 434/211, 213

[56] References Cited

U.S. PATENT DOCUMENTS

| | | | |
|---|---|---|---|
| 185,889 | 1/1877 | Boorman | 434/211 X |
| 1,269,233 | 6/1918 | Warga | 273/157 R |
| 1,409,082 | 3/1922 | Corbett . | |
| 3,659,360 | 5/1972 | Zeischegg | 273/157 R X |
| 3,859,769 | 1/1975 | Watkins | 446/125 X |
| 4,238,905 | 12/1980 | MacGraw | 273/157 R X |
| 4,561,097 | 12/1985 | Siegel | 273/157 R |
| 4,701,131 | 10/1987 | Hildebrandt | 434/211 |

FOREIGN PATENT DOCUMENTS

| | | | |
|---|---|---|---|
| 0295787 | 12/1988 | European Pat. Off. . | |
| 625045 | 2/1936 | Fed. Rep. of Germany . | |
| 1697691 | 5/1955 | Fed. Rep. of Germany . | |
| 6917192 | 4/1969 | Fed. Rep. of Germany . | |
| 7427856 | 8/1974 | Fed. Rep. of Germany . | |
| 8505842 | 3/1985 | Fed. Rep. of Germany . | |
| 323054 | 10/1902 | France | 434/211 |
| 71.16629 | 12/1972 | France . | |
| 2176411 | 12/1986 | United Kingdom . | |

*Primary Examiner*—Mickey Yu

*Attorney, Agent, or Firm*—Fleit, Jacobson, Cohn, Price, Holman & Stern

[57] ABSTRACT

A toy is made up of a number of different elements which fit together in a particular manner to form a spherical body. A first set of elements are each of a pyramid shape with a hexagonal cross-section and a second set of elements are each of a pyramid shape with a pentagonal cross-section. The respective elements fit together in a particular manner to form a spherical body and have interfitting tongue and groove connectors.

4 Claims, 2 Drawing Sheets

TOY MADE OF SEVERAL INTERCONNECTABLE AND ADAPTABLE UNITS

BACKGROUND OF THE INVENTION

The invention concerns a toy consisting of single parts that can be joined together.

As is known, various types of skill games are available on the market which are based on a variety of execution criteria; generally the well known games display a degree of difficulty which cannot be changed in accordance with the various purposes of use, and accordingly, the various known games have degrees of difficulty which are a direct function of the execution criterion on which the game is based.

The purpose of the invention is to create a new type of toy composed of elements or single parts that can be put together, which, aside from the fact that it increases the skill and dexterity of the user, also offers the possibility of being provided with different degrees of difficulty in manipulation without altering the concept on which the game is based.

SUMMARY OF THE INVENTION

The invention devises a toy composed of elements that can be joined together, especially plugged together and possibly locked together (puzzle parts) which, on the one hand, offers an extremely large number of combinations, but on the other, can be executed with a limited number of single elements, which when put together, can be combined into an object, especially one with a spherical shape.

Another advantage is the fact that the toy is especially entertaining and universal and also, when the individual parts are being put together, puts the skill of the player or players to a serious test.

A preferred version of the invention is a toy with individual parts that can be connected or joined together (puzzle parts) which can be put together to form a block shape, especially a spherical object which preferably may have the shape of a soccer ball. The individual parts are formed of a first number (first set) of pyramid-shaped, especially truncated-pyramid-shaped elements with a hexagonal base, and a second number (second set) of pyramid-shaped, especially truncated pyramid-shaped elements with a pentagonal base. The pyramidal elements form puzzle blocks that can be joined to one another in such a way that each puzzle block with a pentagonal base is surrounded by puzzle blocks with a hexagonal base. For this purpose the side faces of said puzzle blocks have connecting means for connection to one another, especially a plug connection of the above-noted blocks. In the assembled state the base faces of the puzzle blocks, i.e. the base faces with the larger areas, form a spherical surface of an object, e.g. a toy soccer ball. Therefore these base faces are preferably designed as hemispheres. Other features and advantages essential to the invention emerge from the following description in which a preferred but not limiting example of execution is described with reference to the drawings.

DESCRIPTION OF PREFERRED EMBODIMENTS

Figure 1:
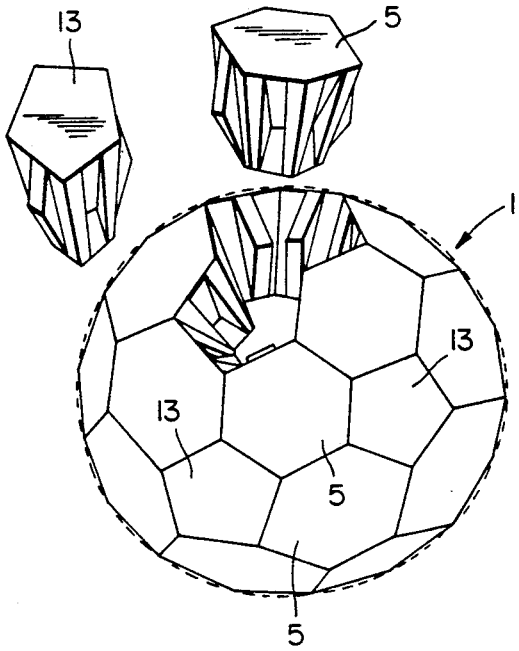
FIG. 1 is a perspective view of the toy according to the invention.
Figure 2:
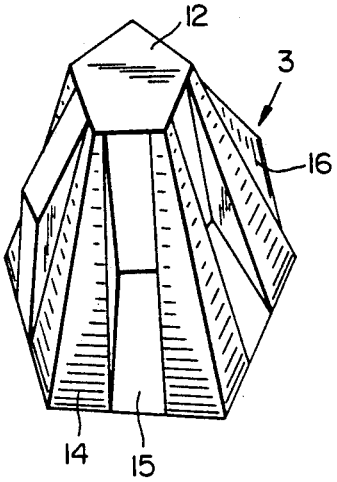
FIG. 2 is a perspective view of a small block with a pentagonal cross section.
Figure 3:
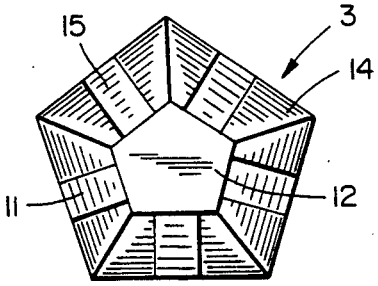
FIG. 3 shows the block in FIG. 2, top view.
Figure 4:
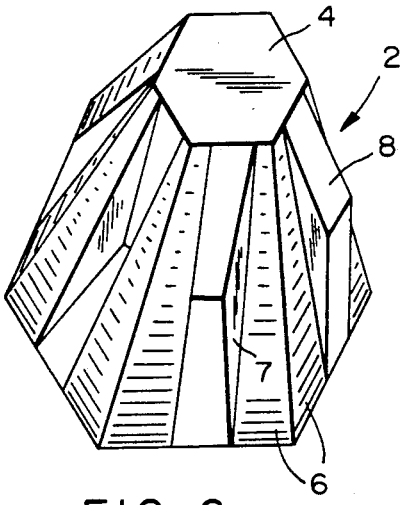
FIG. 4 is a perspective view of a small block with a hexagonal cross section.
Figure 5:
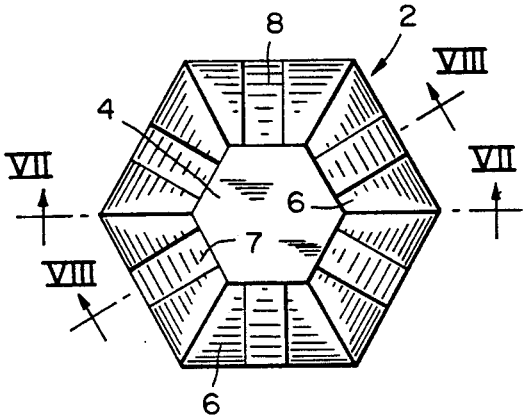
FIGS. 5 and 6 show in top view blocks with hexagonal cross section with different locking means.
Figure 6:
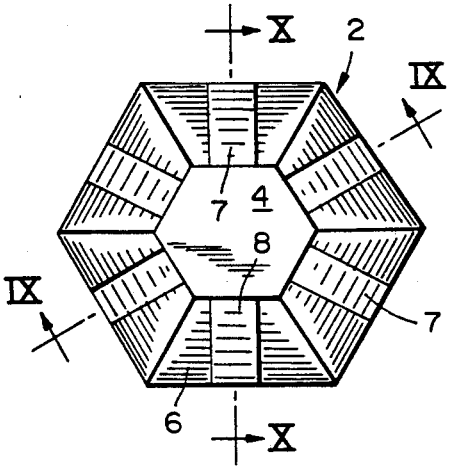
Figure 7:
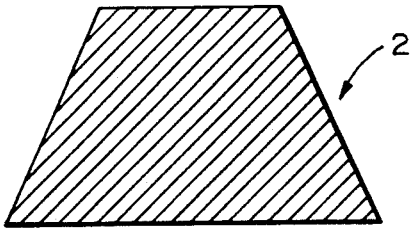
FIGS. 7 and 8 are sectional views along VII—VII and VIII—VIII in FIG. 5.
Figure 9:
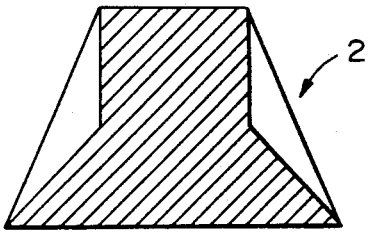
FIG. 9 is a sectional view along IX—IX in FIG. 6.
Figure 8:
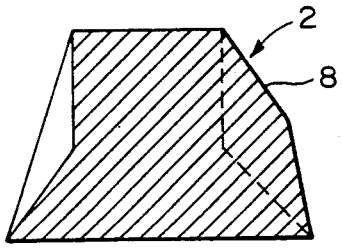
Figure 10:
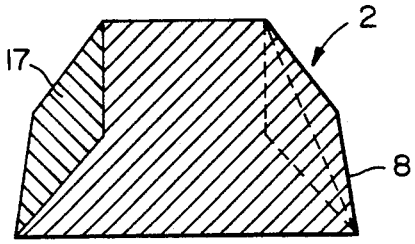
FIG. 10 is a sectional view along lines X—X of FIG. 6 with a schematic supplement by means of a removable locking-in element.
Figure 12:
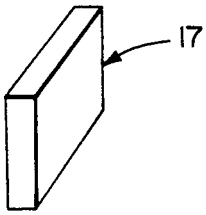
FIG. 12 is a schematic sectional view of a connecting element for the connection between the blocks.
Figure 11:
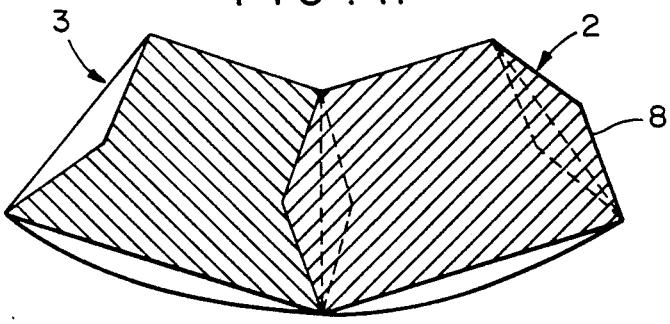
FIG. 11 is a section of the joint between two small blocks.
Figure 13A:
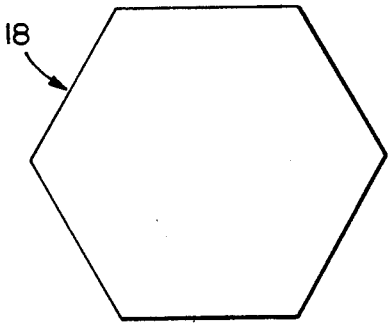
FIG. 13A–13C are top and side outline of an additional covering element with which the element that is created by the combination of the various blocks is given a spherical shape.
Figure 13B:
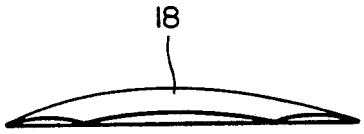
Figure 13C:
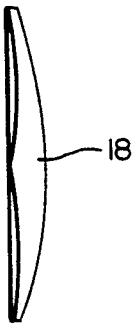

With reference to the drawings above, 1 generally denotes the final toy object which is obtained by joining the single elements (puzzle blocks) 2 and 3 together.

The individual elements 2 and 3 are advantageously designed in the form of small blocks (puzzle blocks) of plastic material or the like, with a pyramidal shape, preferably the shape of a truncated pyramid. The individual elements 2 of a first type have a hexagonal cross section. The individual elements 3 of a second type have a pentagonal cross section.

Each single element 2 has a hexagonal cross section and has a smaller base face 4, a larger base face 5 and side faces 6, while the base face 5 can protrude outward in the manner of a hemisphere (section of spherical surface).

By analogy with this, each single element 3 with a pentagonal cross section has base faces 12 and 13 and side faces 14, the base face 13 having the larger area and may also be curved outwardly in the manner of a hemisphere.

The block-shaped single elements 2 and 3 are joined together in such a way that each pentagonal element 3 is surrounded and bounded by elements 2 with a hexagonal cross section.

The joining is accomplished by mutual, preferably clamping or locking connecting means, especially plug connectors which are provided in the side faces 6 and 14 respectively.

More precisely, in the longitudinal direction of the side faces 6 and 14 grooves designated 7 and 15 are formed which form the female connecting element or the plug socket.

The male connecting element or plug part is created by projections designated 8 and 16 which are plugged into grooves 7 and 15 to form the connection.

The projections 8 and 16 can preferably be formed as one piece with the pyramidal single element 2 and 3 in each case, if desired, in such a way that a separate connecting element 17, e.g. in the form of a rhombus, is created which can be affixed in the corresponding grooves so that a male connecting element or a plug part is created.

The difficulty in putting this toy together increases with increasing number of plug parts that must be connected by being put together with a corresponding plug socket or groove. In addition the arrangement and number of plug parts or grooves acting as plug sockets on the individual elements 2 and 3 in each case can be varied. Moreover, the divided arrangement of the two types of individual elements 2 and 3 may be varied. The greater the number of single elements 2 and 3 is, which require a specific positioning dependent on the nature of the individual elements and the arrangement and number of connecting means (grooves, projections), the greater is the difficulty in joining them together, since the corresponding female plug socket parts, i.e. therefore the grooves, and the plug parts fitting them must necessarily be found in order to obtain a complete connection to form the, e.g. spherical, toy body.

The number of block-shaped single elements 2 and 3 in each case can be determined in order to obtain the desired toy body when joined together. In addition the number and arrangement of the plug parts (projections) and plug sockets (grooves) may be arranged differently on the five and six side faces 14 and 6, respectively, of the individual elements 3 and 2 in each case so that the difficulty in joining them together to form the toy body can be adjusted accordingly.

The individual elements 2,3 can preferably be designed with curved base faces 5,3, i.e. be shaped in accordance with a part of a sphere, or it is also possible to provide additional pieces 18 which are formed from hemispheres with hexagonal and pentagonal flat base faces which can be affixed, e.g. by gluing or the like to the flat base faces of the various pyramid elements. Naturally it is also possible, as the figures show, to make the base faces 3,5 flat.

A combination toy is obtained with the pyramidal single elements 2,3 with pentagonal and hexagonal cross sections in which the degree of difficulty of manipulation can be varied as a function of the requirements of the user in each case.

In addition it is also possible from the manufacturing standpoint to form the connecting means (grooves 7 and 15, projections 8 and 16) as one piece with the individual elements. Only two types of shapes are required if only grooves are formed and the different rhomboidal connecting elements forming longitudinal connecting parts are pushed in.

In practice, the materials used as well as the dimensions and the shapes related to them can be chosen at option according to requirements.

Preferably, the toy body can be shaped on its surface as a soccer ball, the individual elements belonging to the different sets, i.e. having different cross sections, having different colors or patterns on their base faces. For example, the pentagonal single elements may be black on their base faces and the hexagonal single elements white on their base faces. Naturally other color combinations and patterns such as are known on soccer balls may be chosen. The base faces in this case correspond to the face elements of the surface of the soccer ball. Naturally, it is also possible to imitate other objects with the toy body.

I claim:

1. A toy comprising first and second sets of individual toy elements for assembly together to form a spherical toy body, said first set comprising pyramid-shaped elements of hexagonal cross-section, said second set comprising pyramid-shaped elements of pentagonal cross-section, each element of each set having a larger base surface, a smaller base surface and side surfaces extending between the base surfaces, the elements having respective interfitting tongue connectors and groove connectors on the side surfaces extending lengthwise between the respective base surfaces for connecting the elements together to form the toy body with each element of pentagonal cross-section being surrounded by elements of hexagonal cross-section, and the respective larger base surfaces of the elements forming the surface of the toy body, wherein the tongue connectors and groove connectors each have a V-shaped profile in side view with an apex located at a point between the base surfaces.

2. A toy as claimed in claim 1 wherein each element has tongue connectors and groove connectors on alternate side faces respectively.

3. A toy as claimed in claim 1 wherein the tongue connectors are integral with the respective elements.

4. A toy as claimed in claim 1 wherein the larger base surface of each element has a convex shape to form part of the spherical surface.

* * * * *